US006503873B1

(12) United States Patent
Crudden et al.

(10) Patent No.: US 6,503,873 B1
(45) **Date of Patent: *Jan. 7, 2003**

(54) ULTRA MILD DETERGENT COMPOSITIONS

(75) Inventors: Joseph J. Crudden, Hudson, NH (US); Joseph Lazzaro, Hampstead, NH (US); Brian A. Parker, Newlands (IE); John M. Crudden, Hudson, NH (US)

(73) Assignee: Hampshire Chemical Corp, Lexington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/053,770

(22) Filed: Apr. 1, 1998

Related U.S. Application Data

(62) Division of application No. 08/637,574, filed on Apr. 25, 1996, now abandoned.

(51) Int. Cl.[7] ..... C11D 1/04

(52) U.S. Cl. ..... 510/126; 510/434; 510/490; 510/501

(58) Field of Search ..... 510/119, 434, 510/126, 490, 501

(56) References Cited

U.S. PATENT DOCUMENTS

| | | | | |
|---|---|---|---|---|
| 4,144,182 A | 3/1979 | Bereuter | ..... | 252/34 |
| 4,443,362 A | 4/1984 | Guth et al. | ..... | 252/545 |
| 4,704,272 A | 11/1987 | Oh et al. | ..... | 424/70 |
| 5,250,728 A | 10/1993 | Parker et al. | ..... | 562/565 |
| 5,284,972 A | 2/1994 | Parker et al. | ..... | 562/565 |
| 5,621,008 A | 4/1997 | Ptchelintsev | ..... | 514/561 |

FOREIGN PATENT DOCUMENTS

| | | |
|---|---|---|
| DE | 27 22 819 | 12/1977 |

OTHER PUBLICATIONS

J. Crudden et al., "N–acyl ED3A Chelating Surfactant: A New Class of Mild Multifunctional Surfactant for Use in Personal Care" XII Congresso Latino–Amereicano e lberico de Quimicos Cosmeticos, vol. II, Associacao Brasileira de Cosmetologia, Aug. 1995.*

J. Soc. Cosmet.Chem., 31, 223–236 (Sep./Oct. 1980); J. Roger Hart, et al.; "The lathering potential of surfactants–a simplified approach to measurement".

INFORM, vol. 6, No. 10 (Oct. 1995); Joseph J. Crudden, et al.; "N–acyl ED3A chelating surfactants".

* cited by examiner

*Primary Examiner*—John R. Hardee

(57) ABSTRACT

Mild detergent formulation comprising N-acyl ED3A, preferably as the sodium or potassium salt. The acyl group is not particularly limited, and can include straight or branched aliphatic or aromatic groups containing from 1 to 40 carbon atoms, preferably from 8 to 18 carbon atoms. Applications include shampoos and skin cleansers.

18 Claims, 11 Drawing Sheets

- JOHNSONS BABY SHAMPOO (12g/200g)
- KLED3A (8g+4g/200g)
- JOHNSONS BABY + KLED3A (12g/200g)
- JOHNSONS BABY (12g/200g), 200ppm CaCO3
- KLED3A (12g/200g), 200ppm CaCO3
- JOHNSONS BABY + KLED3A (8g+4g/200g), 200ppm CaCO3
- JOHNSONS BABY (12g/200g), 400ppm CaCO3
- JOHNSONS BABY + KLED3A (8g+4g/200g), 400ppm CaCO3

JOHNSONS BABY BATH (12g/200g)

JOHNSONS BABY BATH KLED3A (8g+4g/200g)

JOHNSONS BABY BATH (12g/200g), 200ppm CaCO3

JOHNSONS BABY BATH KLED3A (8g+4g/200g), 200ppm CaCO3

- JOHNSONS BABY SHAMPOO (12g/200g)
- NaLED3A (12g/200g)
- JOHNSONS BABY + NaLED3A (8g+4g/200g)
- JOHNSONS BABY (12g/200g), 200ppm CaCO3
- NaLED3A (12g/200g), 200ppm CaCO3
- JOHNSONS BABY + NaLED3A (8g+4g/200g), 200ppm CaCO3
- JOHNSONS BABY (12g/200g), 400ppm CaCO3
- JOHNSONS BABY + NaLED3A (8g+4g/200g), 400ppm CaCO3

ULTRA MILD DETERGENT COMPOSITIONS

Division of Ser. No. 08/637,574 filed Apr. 25, 1996 now abandoned.

BACKGROUND OF THE INVENTION

Ethylenediaminetriacetic acid (ED3A) and its salts (such as $ED3ANa_3$) have applications in the field of chelating chemistry, and may be used as a starting material in the preparation of strong chelating polymers, oil soluble chelants, surfactants and others. Conventional routes for the synthesis of ethylenediaminetriacetic acid were achieved via its N-benzyl derivative, which was subsequently hydrolyzed in alkaline solutions to $ED3ANa_3$, thus avoiding cyclization to its 2-oxo-1,4-piperazinediacetic acid (3 KP) derivative. One example of the synthesis of ethylenediamine-N,N,N'-triacetic acid is disclosed in *Chemical Abstracts* 78, Vol. 71, page 451, no. 18369c, 1969. There it is stated that ethylenediamine reacts with $ClH_2CCO_2H$ in a 1:3 molar ratio in basic solution at 10° C. for 24 hours to form a mixture from which ethylenediamine-N,N,N'-triacetic acid can be separated by complexing the same with Co(III). The resulting cobalt complexes can be isolated through ion exchange.

U.S. Pat. No. 5,250,728, the disclosure of which is hereby incorporated by reference, discloses a simple process for the synthesis of ED3A or its salts in high yield. Specifically, a salt of N,N'-ethylenediaminediacetic acid ($ED2AH_2$) is condensed with stoichiometric amounts, preferably slight molar excesses of, formaldehyde, at temperature between 0° and 110° C., preferably 0° to 65° C. and pH's greater than 7.0 to form a stable 5-membered ring intermediate. The addition of a cyanide source, such as gaseous or liquid hydrogen cyanide, aqueous solutions of hydrogen cyanide or alkali metal cyanide, in stoichiometric amounts or in a slight molar excess, across this cyclic material at temperatures between 0° and 110° C., preferably between 0° and 65° C., forms ethylenediamine N,N'-diacetic acid-N'-cyanomethyl or salts thereof (mononitrile-diacid). The nitrile in aqueous solutions may be spontaneously cyclized in the presence of less than 3.0 moles base: mole $ED2AH_2$, the base including alkali metal or alkaline earth metal hydroxides, to form 2-oxo-1, 4-piperazinediacetic acid (3 KP) or salts thereof, which is the desired cyclic intermediate. In the presence of excess base, salts of ED3A are formed in excellent yield and purity. This patent also discloses an alternative embodiment in which the starting material is $ED2AH_aX_b$, where X is a base cation, e.g., an alkali or alkaline earth metal, a is 1 to 2, and b is 0 to 1 in aqueous solutions. The reaction mixture also can be acidified to ensure complete formation of carboxymethyl-2-oxopiperazine (the lactarn) prior to the reaction. Formaldehyde is added, essentially resulting in the hydroxymethyl derivative. Upon the addition of a cyanide source, 1-cyanomethyl-4-carboxymethyl-3-ketopiperazine (mononitrile monoacid) or a salt thereof is formed. In place of $CH_2O$ and a cyanide source, $HOCH_2CN$, which is the reaction product of formaldehyde and cyanide, may also be employed in this method. Upon the addition of any suitable base or acid, this material may be hydrolyzed to 3 KP. The addition of a base will open this ring structure to form the salt of ED3A.

U.S. Pat. No. 5,284,972, the disclosure of which is hereby incorporated by reference, discloses N-acyl ED3A derivatives and a process for producing the same. The production of N-acyl derivatives of ethylenediaminetriacetic acid can be accomplished according to the following general reaction scheme:

(I)

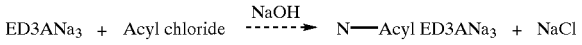

The starting ED3A derivative can be the acid itself, or suitable salts thereof, such as alkali metal and alkaline earth metal salts, preferably sodium or potassium salts.

Saturated N-Acyl ED3A derivatives that are the product of the foregoing reaction can be represented by the following chemical formula:

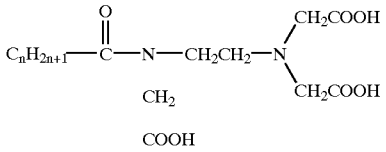

wherein n is from 1 to 40. Where unsaturation occurs, the structure may be shown as follows:

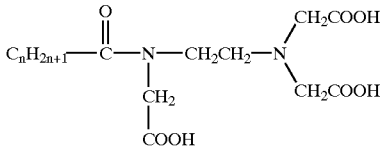

where n is from 2 to 40. As unsaturation increases, the formulae are:

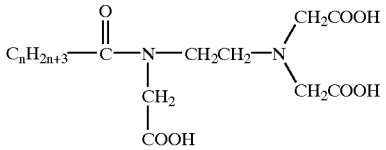

where n is 3 to 40;

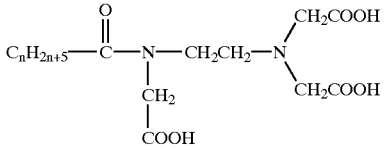

where n is 4 to 40; and

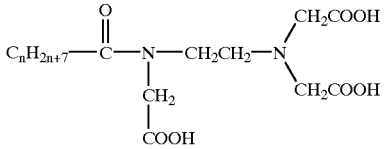

where n is 5 to 40, etc.

Poly N-acyl ethylenediaminetriacetic acid derivatives, such as dicarboxylic acid derivatives having the following general formula also can be produced:

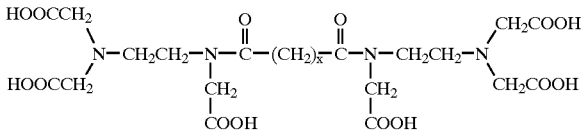

or:

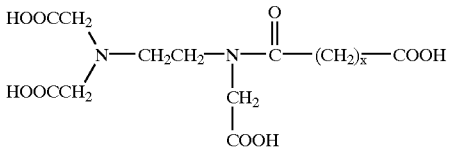

where x is 1 to 40. Specific examples include mono and di ED3A derivatives such as oxalyldi ED3A, oxalylmono ED3A, maleylmono ED3A, maleyldi ED3A, succinoylmono ED3A, succinoyldi ED3A, etc.

Hair shampoos that are mild in terms of skin and eye irritation are desirable, especially for use on infant and children hair. "No more tears" Johnson & Johnson baby shampoo is an example of such a mild shampoo commercially available. However, such shampoos tend to be relatively ineffective in terms of lather formation, and are rather intolerant to water hardness.

The present inventors have found that N-acyl ED3A, when produced in pure form with impurities such as free fatty acids below about 1%, function surprisingly well as chelating surfactants, combining the properties of a chelating agent and a surfactant in one molecule. Detergent compositions containing N-acyl ED3A exhibit copious lather and cleansing properties and low ocular irritancy. Accordingly, these chelating surfactants can be advantageously used in detergent formulations including shampoos and skin cleansers.

It is therefore an objection of the present invention to provide novel detergent compositions comprising N-acyl ED3A.

It is a further object of the present invention to provide a mild shampoo that has acceptable lather formation, even in the presence of high water hardness.

It is a still further object of the present invention to provide a mild shampoo that causes minimal eye irritancy and low toxicity.

It is a further object of the present invention to provide a mild skin cleanser that has acceptable lather formation, minimal eye irritancy and low toxicity.

SUMMARY OF THE INVENTION

The problems of the prior art have been overcome by the instant invention, which provides a mild detergent formulation comprising N-acyl ED3A, preferably as the sodium or potassium salt. The acyl group is not particularly limited, and can include straight or branched aliphatic or aromatic groups containing from 1 to 40 carbon atoms, preferably from 8 to 18 carbon atoms.

DETAILED DESCRIPTION OF THE PRESENT INVENTION

Figure 1:
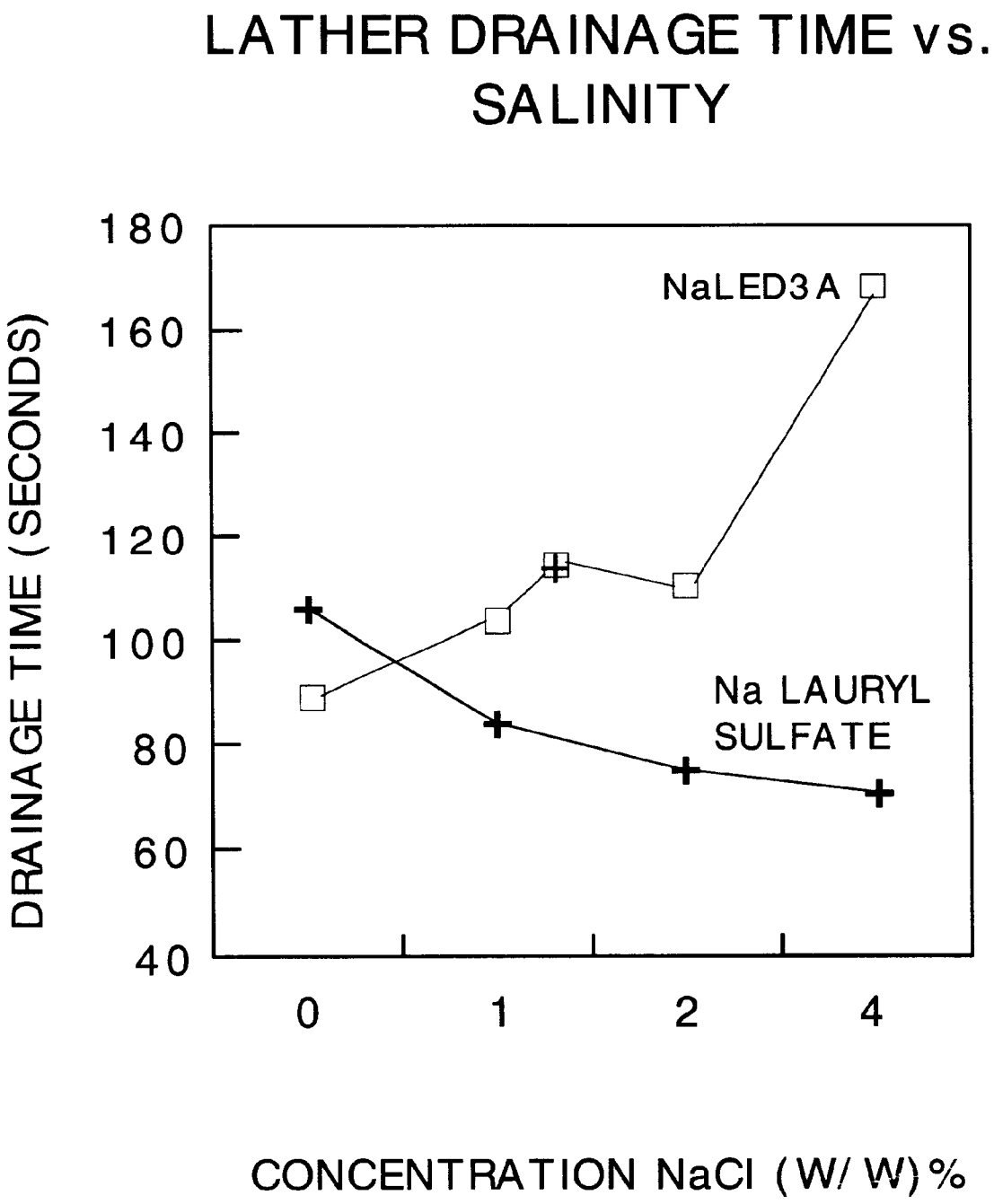
FIGS. 1–11 are graphs comparing lather stability of various compositions.

Those skilled in the art will recognize that the N-acyl ED3A suitable for use in the present invention can be prepared according to reaction (I) above from any acyl chloride, including pentanoyl, hexanoyl, heptanoyl, octanoyl, nananoyl, decanoyl, lauroyl, myristoyl, palmitoyl, oleoyl, stearoyl and nonanoyl. Branched acyl chlorides, such as neopentanoyl, neoheptanoyl, neodecanoyl, iso-octanoyl, iso-nonanoyl and iso-tridecanoyl, as well as aromatic acyl groups, such as benzoyl and napthoyl are also suitable. The fatty acid chains may be substituted, such as by one or more halogen and/or hydroxyl groups. Examples of hydroxy-substituted fatty acids including ipurolic (3,11-dihyroxytetradecanoic), ustilic (2,15,16-trihydroxyhexadecanoic), ambrettolic (16-hydroxy-7-hexadecanoic), ricinoleic (12-hydroxy-cis-9-octadecenoic), ricinelailic (12-hydroxy-trans-9-octadecenoic), 9,10-dihydroxyoctadecanoic, 12-hydroxyoctadecanoic, kalmlolenic (18-hydroxy-8,11,13-octadecatrienoic), ximenynolic (8-hydroxy-trans-11-octadecene-9-ynoic), isanolic (8-hydroxy-17-octadecene-9,11-diynoic) and lequerolic)14-hydroxy-cis-11-eicosenoic), as well as acyl chlorides of the above (the above named derivatives wherein the suffix "oic" is replaced by "oyl chloride"). Suitable halogen-substituted fatty acids include trifluoromethylbenzoyl chloride, pentadecafluoro-octanoyl chloride, pentafluoropropionoyl chloride, pentafluorobenzoyl chloride, perfluorostearoyl chloride, perfluorononamoyl chloride, perfluoroheptanoyl chloride and trifluoromethylacetyl chloride. Preferably, the N-acyl group contains from 8 to 18 carbon atoms.

The N-acyl ED3A is preferably used in the form of its salts, in view of their solubility. Where the N-acyl ED3A acid is first produced, it can be readily converted into salts by partial or complete neutralization of the acid with the appropriate base. The acid also can be produced from N-acyl ED3A salts by neutralization of the base with a quantitative amount of acid. The preferred chelating surfactants for use in the detergent compositions of the present invention are sodium and potassium lauroyl-ED3A. Other suitable counterions include triethanolamine, diethanolamine, monoethanolamine, ammonium, isopropyl amine, N-propylamine and amino alcohols such as 2-amino-1-butanol, 2-amino-2-methyl-1,3-propane diol, 2-amino-2-methyl-1-propanol, 2-amino-2-ethyl-1,3-propane diol and Tris(hydroxylmethyl) aminomethane.

The N-acyl ED3A salt can be used in the detergent compositions of the present invention alone or in combination with other surfactants. The total amount of active surfactant in the composition is generally between about 3 to about 30%, preferably between about 10 to about 15%. The N-acyl ED3A can be a minor or a major portion of the active surfactant, depending upon the desired mildness and other characteristics of the formulation. Conventional surfactants that may be used in combination with the N-acyl ED3A include sarcosinates (including oleoyl, lauroyl and myristoyl), N-acyl glutamates, amphoteric imidazoline derivatives, fatty sulphosuccinate esters and amides, soluble linear alkylbenzene sulfonate, alkyl sulfate and alkyl ethoxy sulfates, sodium lauryl ether sulfate; alcohol ethyoxylates and alkyl polyglycosides; $C_{12}$–$C_{14}$ trimethyl ammonium chloride, di-tallow di-methyl ammonium chloride; and di-tallow methylamine, etc. Many of the foregoing are often used in combination. Imidazolines are usually combined with ethoxylated sorbitan or mannitan esters. The pH of the detergent composition should be within a range of about 6 to about 8. A pH of about 7 is especially preferred to minimize ocular irritancy.

Other ingredients conventionally added to detergent compositions may be included, such as dyes, perfumes, thickeners (such as electrolytes, natural gums, alginates, cellulose derivatives and carboxyvinyl polymers), thinners, conditioning agents (such as lanolin, mineral oil, polypeptides, herbal additives, egg derivatives and synthetic resins), emollients, buffering agents, opacifiers (such as alkanolamides of higher fatty acids, glycol mono and distearates, propyleneglycol and glycerol monostearates, fatty alcohols, emulsions of vinyl polymers and latexes, insoluble salts, finely dispersed zinc oxide or titanium dioxide and magnesium aluminum silicate), preservatives (such as formaldehyde, phenyl mercuric salts and esters of p-hydroxy benzoic acid), antioxidants, etc.

A typical baby shampoo formulation is as follows:

| | |
|---|---|
| Sodium lauroyl ED3A | 17.1% |
| Tridecylether sulphate salt 4.4 EtO 65% | 8.3% |
| Polyoxyethylene (100) sorbitan monolaurate | 7.5% |
| Preservatives, perfume, dye | q.s. |
| Water | to 100% |

The ability of many surfactants to produce good lather is inhibited by the presence of excess electrolyte, such as sodium chloride, and multivalent hardness ions, such as $Ca^{++}$ and $Mg^{++}$. Surprisingly, the present inventors have found that such electrolytes and hardness ions actually significantly enhance the lather stability of alkali metal N-acyl ED3A.

EXAMPLE 1

The lather stability of a surfactant solution, expressed as lather drainage time, can be determined by the method of Hart and DeGeorge, *J. Soc. Cosmet. Chem.,* 31, 223–226 (1980). In this method, a 200 ml portion of the test solution is agitated in a blender for one minute. The lather produced is immediately poured into a Nalgene PF150 funnel, which has been modified for easy detection of endpoint by incorporation of a fine strand of Nicrome wire across the funnel, where the diameter is 9 cm. The funnel is supported by a 20-mesh sieve. The time elapsed between pouring of the blender contents into the funnel and reappearance of the wire through the subsiding foam, determined using a stopwatch, is reported as the lather drainage time in seconds. A stable, high-lathering surfactant might be expected to exhibit a drainage time of 60–100 seconds for a 1% solution, whereas an unstable lather would be expected to yield a value of less than 10 seconds.

The effect of sodium chloride on the lather drainage time of a 1% solution of Na lauroyl ED3A, at pH 7, was compared to the effect on sodium lauryl sulfate, a common surfactant used in detergent formulations. The results are shown in FIG. 1. The lather drainage time for sodium lauryl sulfate is depressed by 30 seconds upon the addition of 4% electrolyte, whereas the time for Na LED3A is increased by more than 70 seconds by the same increase in salinity.

EXAMPLE 2

Figure 2:
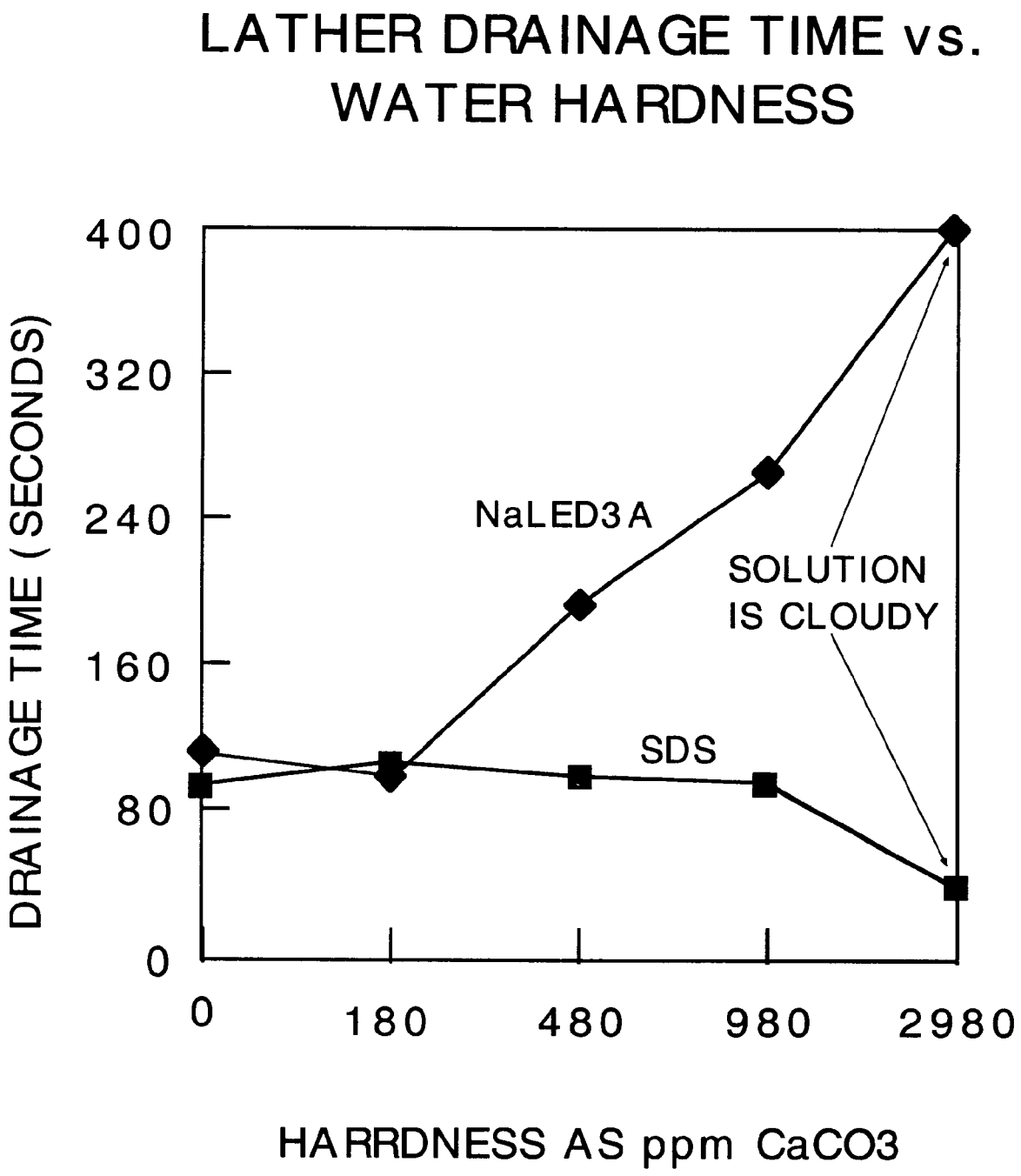

The lather drainage time test was used to determine the effect of water hardness ions on the lather stability of sodium lauroyl ED3A. FIG. 2 shows that the addition of approximately 3,000 ppm of water hardness ($CaCO_3$) resulted in a five-fold increase in the lather stability of a 1% solution of NaLED3A. In contrast, an equivalent addition to sodium lauryl sulfate resulted in a five-fold reduction in lather drainage time.

EXAMPLE 3

A commercial baby shampoo (Johnsons Baby Shampoo) having the composition listed below, was dried to constant weight in an oven at 100° C. The product was found to contain about 16% solids.

Composition

Figure 10:
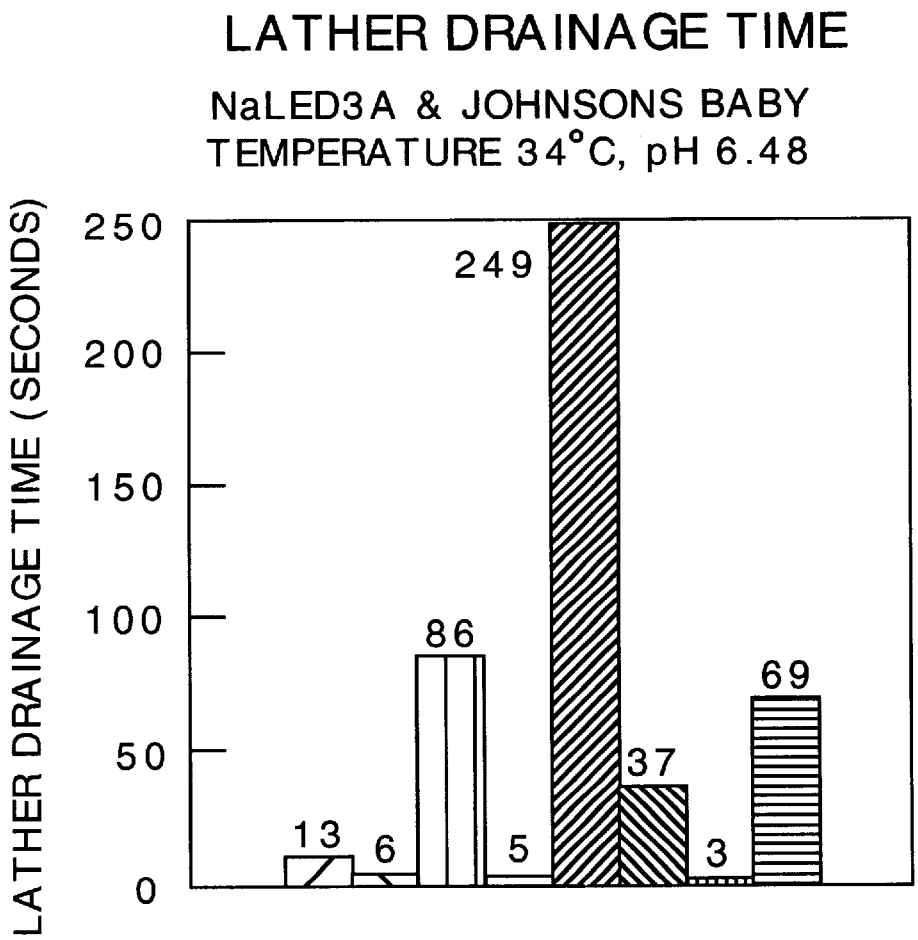

Water, PEG-80 Sorbitan Laurate, Cocamido Propyl Betaine, Sodium Trideceth Sulfate, Glycerin, Lauroamphoglycinate, PEG 150 Distearate, Sodium Laureth-13 Carboxylate, Fragrance, Polyquaternium-10, Tetrasodium EDTA, Quaternium 15, Citric Acid, Color High purity lauroyl ED3A was neutralized to about pH 7 with about 2 moles of sodium hydroxide and diluted to a concentration of about 16%. Solutions of 1) the aforementioned commercial baby shampoo, 2) $Na_2$LED3A, and 3) a 3:1 ratio blend of baby shampoo and $Na_2$LED3A were subjected to lather stability testing using the method set forth in Example 1. The results are shown in FIG. 10.

The addition of $Na_2$LED3A, as one-third of the product, enhanced the lather stability of the product approximately 7-fold in both hard and soft water. The system with $Na_2$LED3A in the presence of 200 ppm hardness was the most effective lathering agent with a drainage time of over 200 seconds.

EXAMPLE 4

Samples of 1) the aforementioned commercial baby shampoo, 2) $Na_2$LED3A, 3) a 3:1 ratio blend of baby shampoo and $Na_2$LED3A, and 4) a 16% solution of sodium laureth 3 sulfate (a surfactant commonly used in ordinary shampoo) were subjected to in vitro skin irritation testing. A sample of the tissue is immersed for 24 hours in a solution of the substance to be evaluated and later assayed for viable mitochondria by an MTT assay. The MTT assay is a colorimetric method for determining cell viability based on the reduction of a tetrazolium salt (MTT) into a colored formazan dye by mitochondrial enzymes of the electron transport chain. The extent to which the number of viable mitochondria has been reduced, compared to a control, is taken as a measure of the toxicity of the test substance to human skin cels. The in vitro scoring classification used was as follows:

| In vitro Score MTT-50 (micro g/ml) | Classification |
|---|---|
| 0–200 | Severe |
| 201–1,000 | Moderate |
| 1,001–10,000 | Mild |
| >10,000 | Non-irritant |

The results are shown in Table 2:

TABLE 2

| Product | In vitro Score MTT-50 (micro g/ml) | Classification |
|---|---|---|
| Baby Shampoo | 1,900 | Mild |
| Baby Shampoo + $Na_2$LED3A | 2,149 | Mild |
| $Na_2$LED3A | >10,000 | Non-irritant |
| Na Laureth(3) sulfate | 522 | Moderate |

These results indicate that $Na_2$LED3A is compatible with the ingredients in mild shampoos and can enhance the performance while reducing irritation. The surfactant itself can function as a shampoo at 16% concentration and is extremely mild. The potential for its incorporation into formulations containing additives such as thickening agents, conditioners, color, fragrance and other ingredients is clear.

EXAMPLE 5

Figure 3:
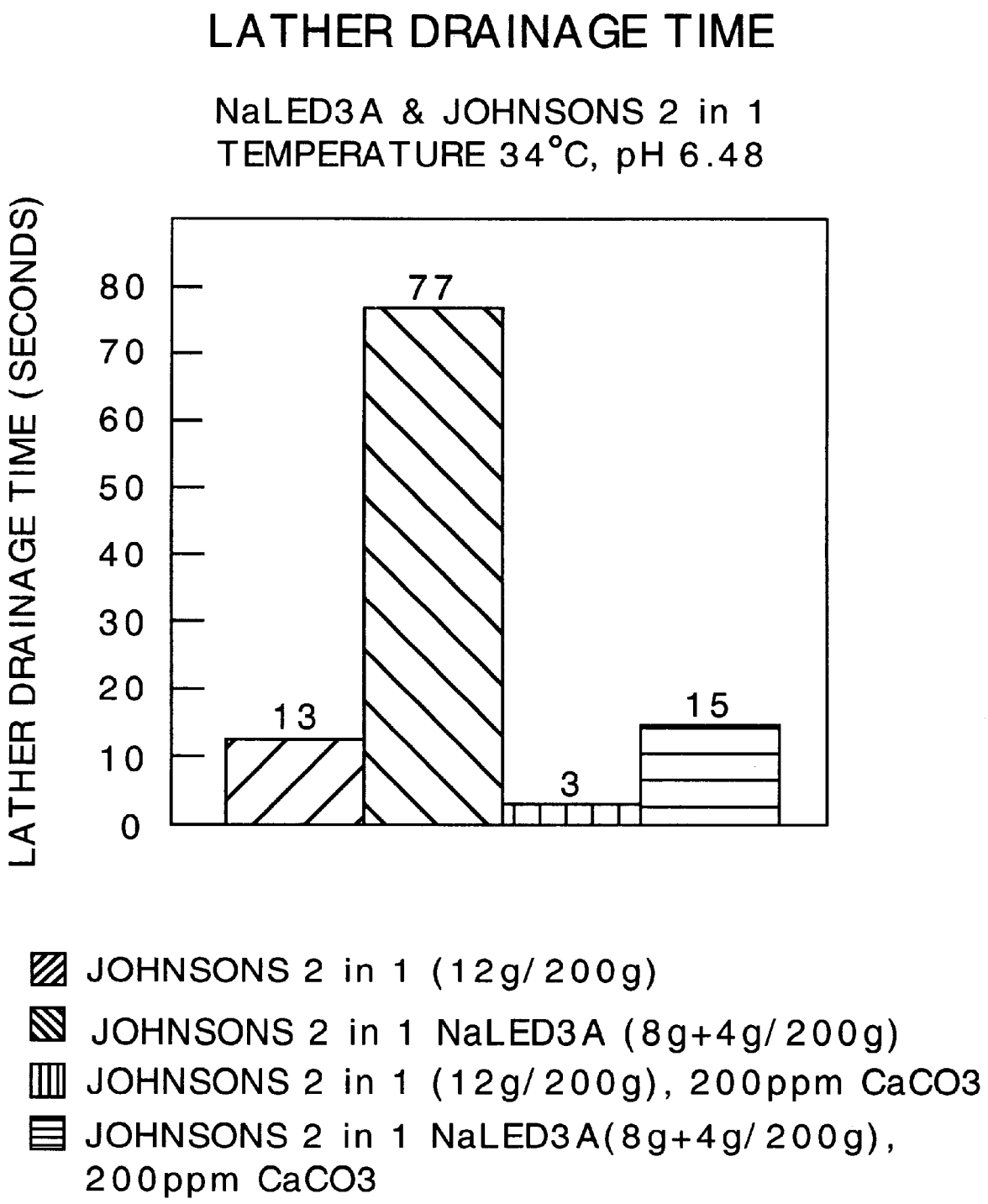

High purity lauroyl ED3A was neutralized to about pH 7 with about 2 moles of sodium hydroxide and diluted to a concentration of about 16%. Solutions of 1) Johnsons Baby 2 in 1 shampoo, and 2) a 3:1 ratio of Johnsons Baby 2 in 1 shampoo and $Na_2$LED3A were subjected to lather stability testing using the method set forth in Example 1. The results are shown in FIG. 3.

The addition of $Na_2$LED3A, as one-third of the product, enhanced the lather stability of the product approximately 6-fold in soft water and 5-fold in hard water.

EXAMPLE 6

Figure 4:
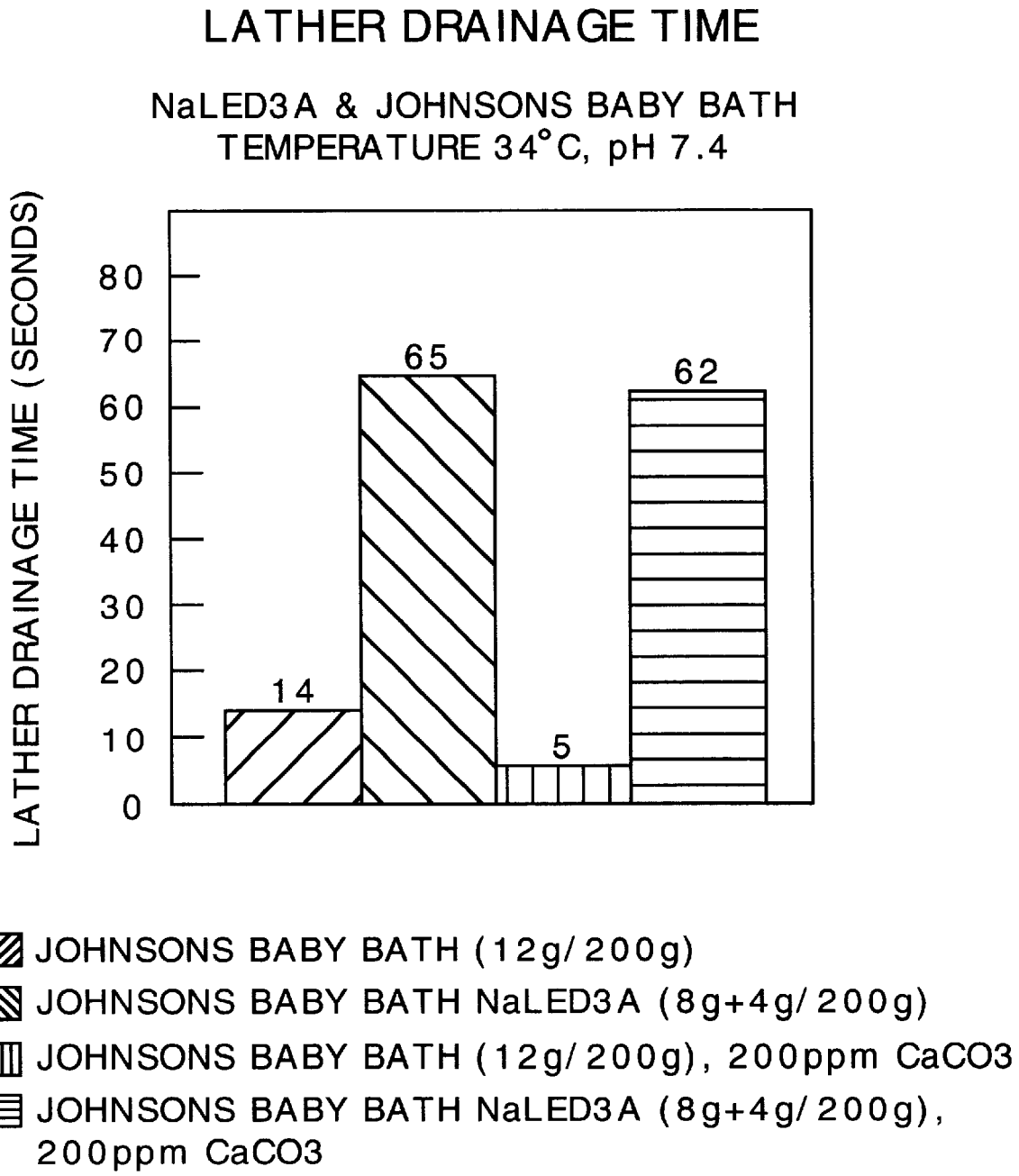

High purity lauroyl ED3A was neutralized to about pH 7 with about 2 moles of sodium hydroxide and diluted to a concentration of about 16%. Solutions of 1) Johnsons Baby Bath, and 2) a 3:1 ratio of Johnsons Baby Bath and $Na_2$LED3A were subjected to lather stability testing using the method set forth in Example 1. The results are shown in FIG. 4.

The addition of $Na_2$LED3A, as one-third of the product, enhanced the lather stability of the product more than 4-fold in soft water and more than 12-fold in hard water.

EXAMPLE 7

Figure 5:
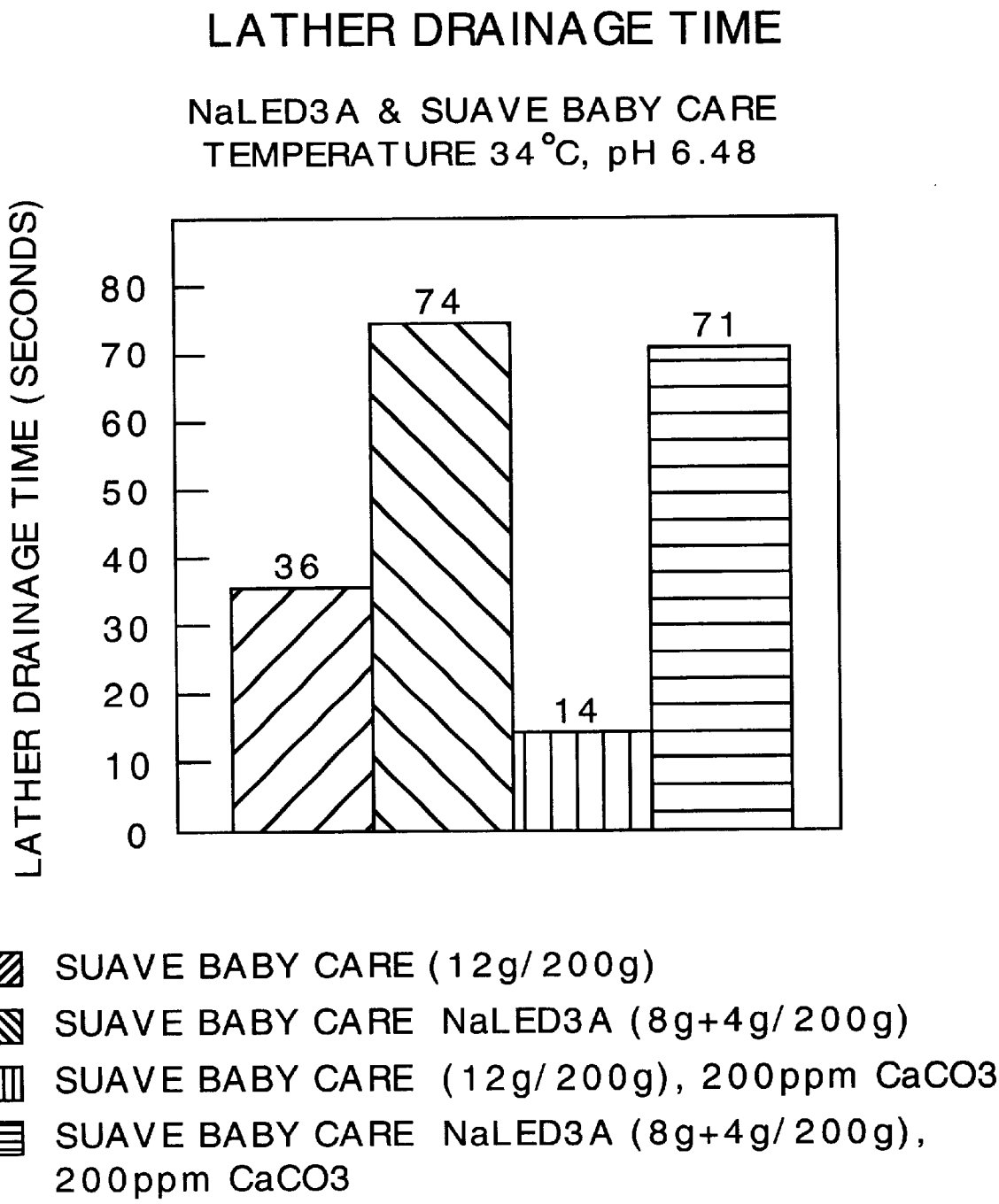

High purity lauroyl ED3A was neutralized to about pH 7 with about 2 moles of sodium hydroxide and diluted to a concentration of about 16%. Solutions of 1) Suave Baby Care, and 2) a 3:1 ratio of Suave Baby Care and $Na_2$LED3A were subjected to lather stability testing using the method set forth in Example 1. The results are shown in FIG. 5.

The addition of $Na_2$LED3A, as one-third of the product, more than doubled the lather stability of the product in soft water. The addition of $Na_2$LED3A enhanced the lather stability of the product more than 5-fold in hard water.

EXAMPLE 8

Figure 6:
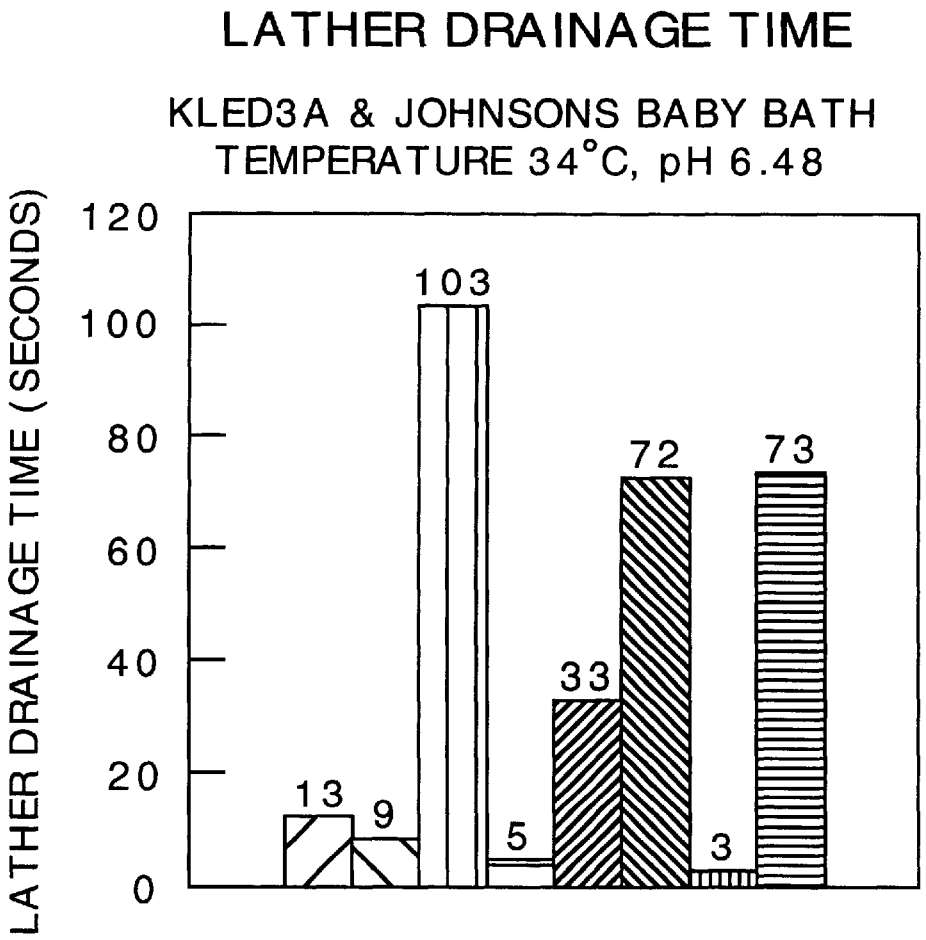

Example 3 was repeated except that potassium LED3A was substituted for sodium LED3A. The results are shown in FIG. 6.

The addition of $K_2$LED3A, as one-third of the product, enhanced the lather stability of the product approximately 8-fold in soft water, more than 14-fold in hard water (200 ppm $CaCO_3$), and more than 24-fold in even harder water (400 ppm $CaCO_3$).

EXAMPLE 9

Figure 7:
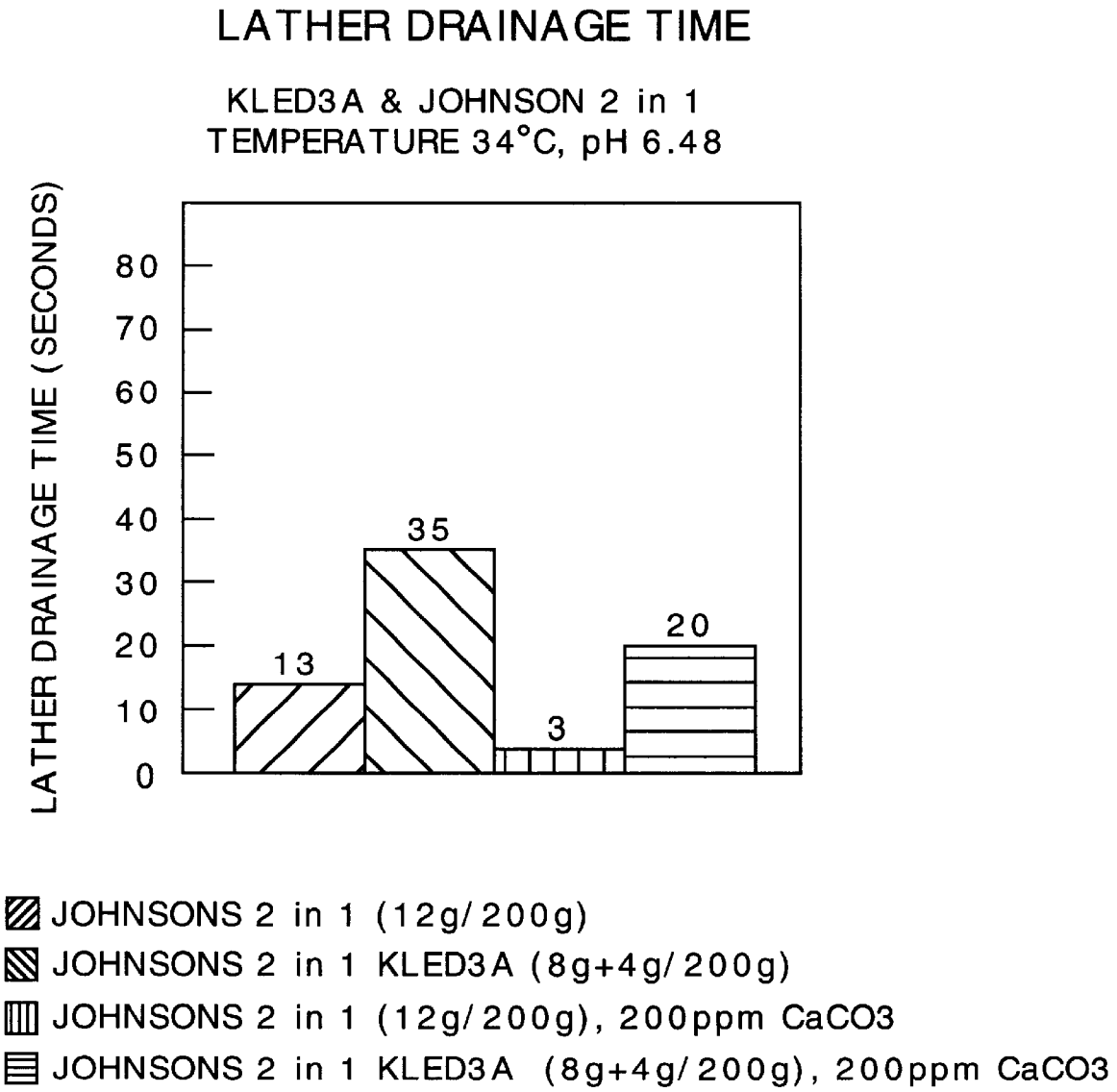

Example 5 was repeated except that potassium LED3A was substituted for sodium LED3A. The results are shown in FIG. 7.

The addition of $K_2$LED3A, as one-third of the product, enhanced the lather stability of the product more than 2-fold in soft water, and approximately 7-fold in hard water (200 ppm $CaCO_3$).

EXAMPLE 10

Figure 8:
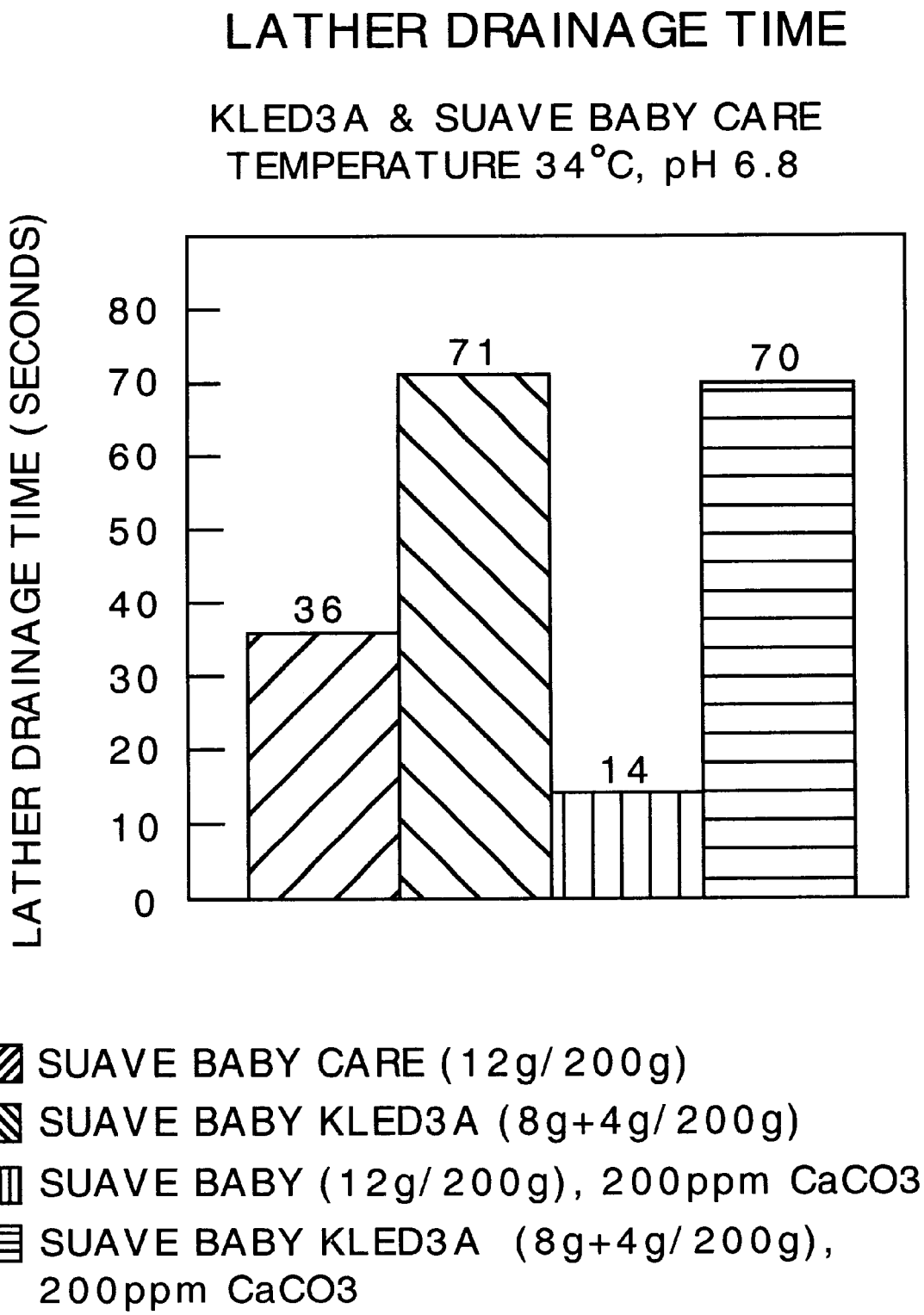

Example 6 was repeated except that potassium LED3A was substituted for sodium LED3A. The results are shown in FIG. 8.

The addition of $K_2$LED3A, as one-third of the product, enhanced the lather stability of the product approximately 5-fold in soft water, and approximately 12-fold in hard water (200 ppm $CaCO_3$).

EXAMPLE 11

Figure 9:
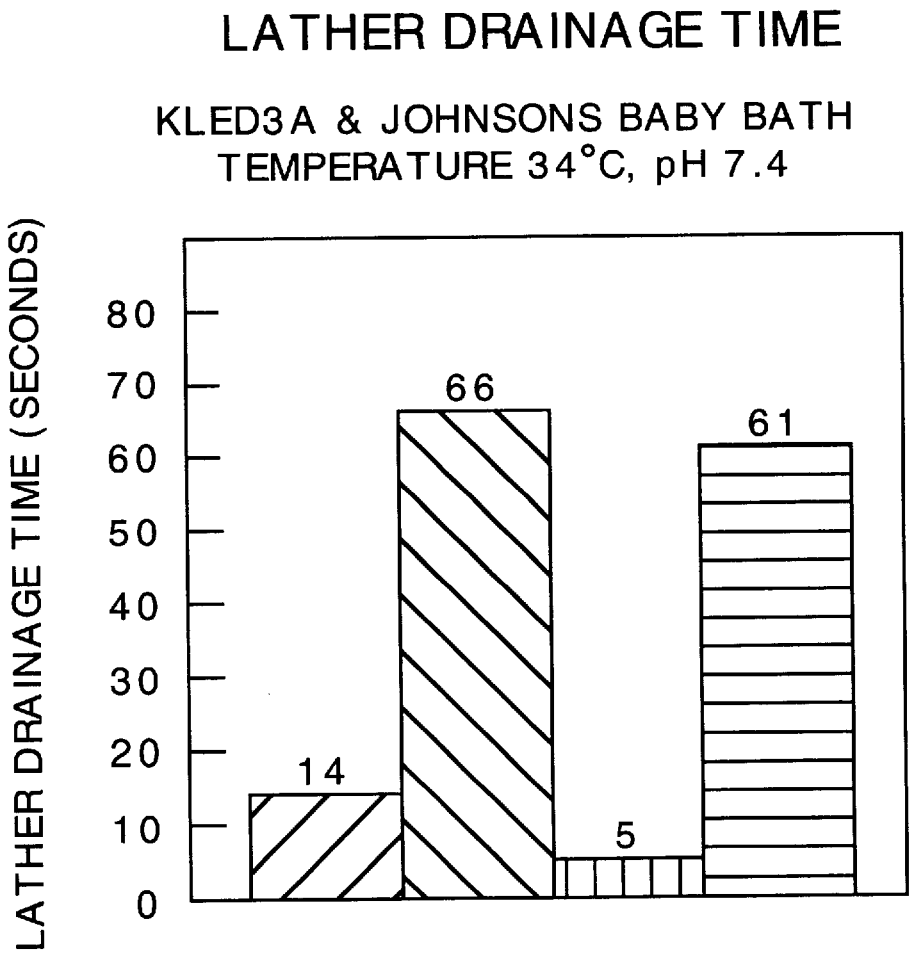

Example 7 was repeated except that potassium LED3A was substituted for sodium LED3A. The results are shown in FIG. 9.

The addition of $K_2$LED3A, as one-third of the product, enhanced the lather stability of the product approximately 2-fold in soft water, and 5-fold in hard water (200 ppm $CaCO_3$).

EXAMPLE 12

Figure 11:
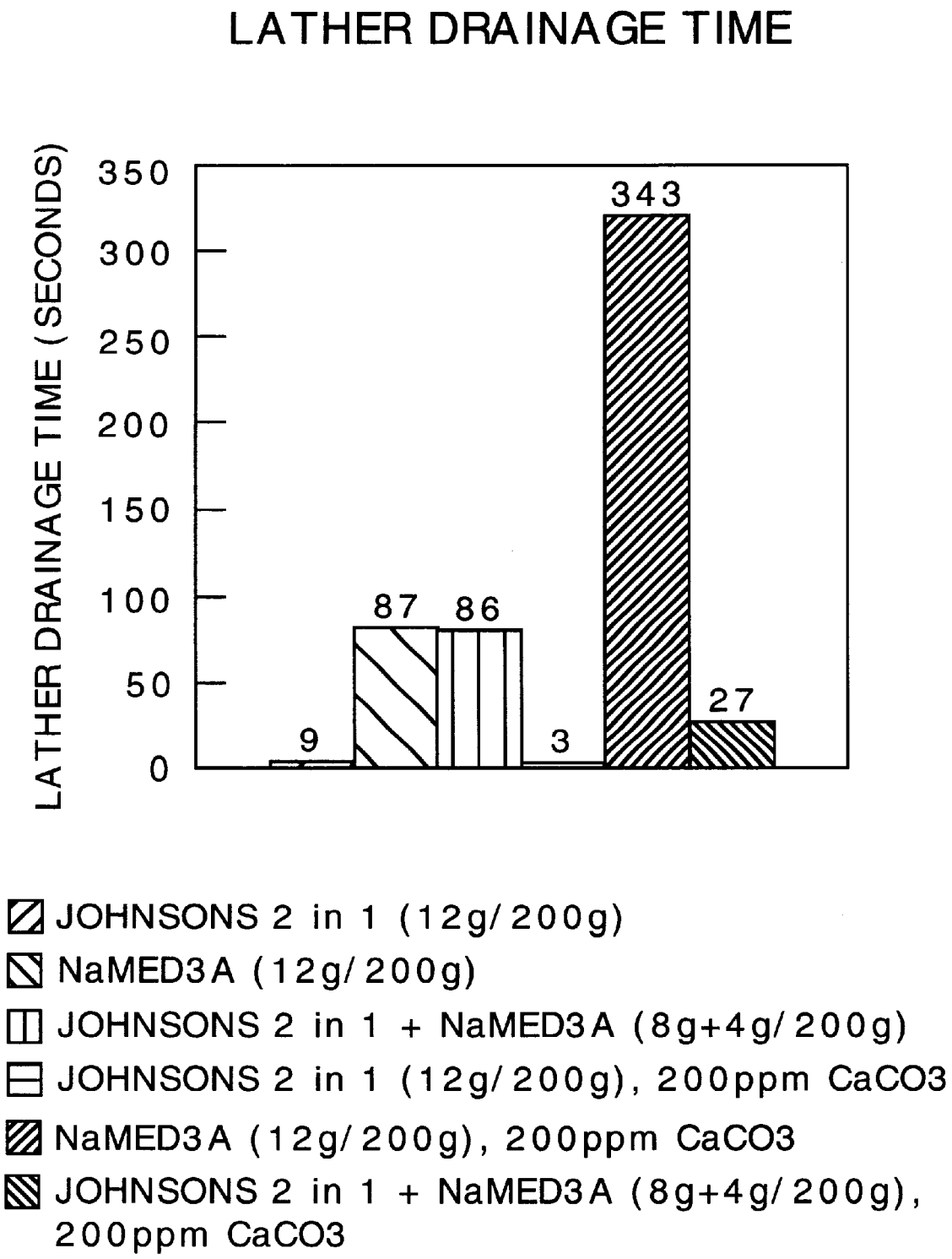

Example 3 was repeated except that sodium myristoyl ED3A was substituted for sodium LED3A, and Johnsons Baby 2 in 1 shampoo was substituted for Johnsons Baby Shampoo. The results are shown in FIG. 11.

The addition of $Na_2$MED3A, as one-third of the product, enhanced the lather stability of the product more than 9-fold in soft water, and 9-fold in hard water (200 ppm $CaCO_3$). The pure sodium myristoyl ED3A more than 100 times more effective in the hard water than the baby shampoo alone.

EXAMPLE 13

LED3A was neutralized to about pH 7 with about 2 moles of tris amino. The concentration was adjusted to 16% active. The solution was maintained at 80° C. for 20 minutes to ensure sterility. The solution was diluted 10 to 1 with distilled water. Two drops of this 1.6% solution was instilled into one eye of 2 human subjects and allowed to thoroughly wet the surface. The second eye of each subject was instilled with 2 drops of a 1.6% solution of Johnsons Baby Shampoo and allowed to thoroughly wet the surface. Neither subject was aware of the identity of the samples. Both subjects identified the tris amino LED3A sample as producing significantly less eye sting then the Baby Shampoo, a commercial low irritancy shampoo.

What is claimed is:

1. A method of shampooing hair comprising applying to said hair a mild detergent composition comprising an effective amount of a salt of N-acyl ethylenediaminetriacetic acid, wherein said acyl group is a straight or branched aliphatic or aromatic group containing from 1 to 40 carbon atoms.

2. The method of claim 1, wherein said salt is present in an amount of from about 3 to about 30% by weight of the composition.

3. The method of claim 1, wherein said acyl group contains from 8 to 18 carbon atoms.

4. The method of claim 1, wherein said salt of N-acyl ethylenediaminetriacetic acid is an alkali metal salt.

5. The method of claim 1, wherein said salt of N-acyl ethylenediaminetriacetic acid is an amino alcohol salt.

6. The method of claim 1, wherein said acyl group is selected from the group consisting of lauroyl, oleoyl and myristoyl.

7. The method of claim 1, wherein said acyl group is lauroyl.

8. The method of claim 1, further comprising a co-surfactant.

9. The method of claim 1, further comprising applying said composition to said hair in the presence of multivalent hardness ions.

10. A method of cleansing skin comprising applying to said skin a mild detergent composition comprising an effective amount of a salt of N-acyl ethylenediaminetriacetic acid, wherein said acyl group is a straight or branched aliphatic or aromatic group containing from 1 to 40 carbon atoms.

11. The method of claim 10, wherein said salt is present in an amount of from about 3 to about 30% by weight of the composition.

12. The method of claim 10, wherein said acyl group contains from 8 to 18 carbon atoms.

13. The method of claim 10, wherein said salt of N-acyl ethylenediaminetriacetic acid is an alkali metal salt.

14. The method of claim 10, wherein said salt of N-acyl ethylenediaminetriacetic acid is an amino alcohol salt.

15. The method of claim 10, wherein said acyl group is selected from the group consisting of lauroyl, oleoyl and myristoyl.

16. The method of claim 10, wherein said acyl group is lauroyl.

17. The method of claim 10, further comprising a co-surfactant.

18. The method of claim 10, further comprising applying said composition to said skin in the presence of multivalent hardness ions.

* * * * *